US006124809A

United States Patent [19]

Boudriau

[11] Patent Number: 6,124,809

[45] Date of Patent: Sep. 26, 2000

[54] SAFETY SYSTEM FOR MARINE VEHICLE

[76] Inventor: Pierre Boudriau, 624 Rang des Dusseault, St-Sebastien, Que., Canada, J0J 2C0

[21] Appl. No.: 09/391,328

[22] Filed: Sep. 7, 1999

[30] Foreign Application Priority Data

Sep. 8, 1998 [GB] United Kingdom ..... 9819466

[51] Int. Cl.[7] ..... G08B 23/00

[52] U.S. Cl. ..... 340/984; 114/270; 440/84; 440/1

[58] Field of Search ..... 340/984; 701/21; 114/270; 440/84, 87, 1

[56] References Cited

U.S. PATENT DOCUMENTS

| | | | |
|---|---|---|---|
| 4,008,781 | 2/1977 | Ochiai | 200/61.47 |
| 4,767,363 | 8/1988 | Uchida et al. | 440/1 |
| 5,582,125 | 12/1996 | Matsumoto | 114/270 |
| 5,967,862 | 10/1999 | Motose | 440/84 |

*Primary Examiner*—Brent Swarthout
*Attorney, Agent, or Firm*—Eric Fincham

[57] ABSTRACT

A safety system for marine vehicles such as personal watercraft which have a motor and throttle means for controlling the motor speed, the safety system comprising sensors for detecting a turning motion of the marine vehicle and a system to maintain power to the motor for a predetermined period of time when the throttle controls are abruptly released during a turning motion.

9 Claims, 6 Drawing Sheets

SAFETY SYSTEM FOR MARINE VEHICLE

The present invention relates to a safety system and more particularly, relates to a safety system for a marine vehicle.

BACKGROUND OF THE INVENTION

The use of various types of marine vehicles is well known in the art and many different types of boats and personal watercraft have gained a wise degree of acceptance. Originally, the use of marine vehicles was restricted to those who could afford the rather substantial expenses of both owning a boat and having access to water for use of the same. As such, the operators of the marine vehicles tended to be well trained in the use of their vehicles.

More recently, personal watercraft have gained a wide degree of popularity and are available to the ordinary consumer. Indeed, many different resort areas have rental areas where the use of the personal watercraft is wide spread. However, many of the operators do not have the background or experience and as a result, the personal watercraft have been signaled out as a hazard both to the operator and to other marine vehicles. In some jurisdictions, there have been proposals to limit or completely ban such personal watercraft.

For an inexperienced operator, one of the main drawbacks associated with such personal watercraft is the high speed such watercraft can obtain and that in order to manoeuver the watercraft, handlebars or like must be turned and the propulsion means must be activated since the vehicle is not equipped with a conventional rudder type of mechanism. Typically, the operator turns the watercraft by turning a handlebar which operates a steering mechanism for turning a discharge nozzle.

In other words, in order to steer the personal watercraft, the operator must simultaneously operate the throttle control and the handlebar. To the inexperienced operator, this can sometimes seem to be paradoxical situation since a novice operator will typically back off or release the throttle in an emergency situation such as when another watercraft or obstacle arises. However, one is unable to steer without the application of sufficient thrust from the throttle. It would therefore be desirable to have a safety system which obviates the above conditions.

There have been proposals in the art for automatic speed adjusting devices. Generally, these devices have been suggested for the purpose of slowing down the vehicle when it is passing through a turn so as to overcome any results occurring from too high a speed. Thus, U.S. Pat. No. 4,008,781 discloses a device for controlling the speed of a vehicle as it negotiates a curve. Basically, a U-shaped tube having mercury contact switches is employed. Such a device is useful for use in an automobile which is operated at a speed which may exceed the allowable speed for a curve in a road. A similar type of device has been proposed for marine vehicles in U.S. Pat. No. 4,767,363 wherein there is provided a control system for a watercraft that prevents existence of more than a predetermined degree of acceleration when the watercraft is being steered through a substantial steering angle. This is substantially the opposite of what is required for marine vehicles such as personal watercraft.

SUMMARY OF THE INVENTION

It is therefore an object of the present invention to provide a safety system for a marine vehicle wherein the system ensures sufficient power is present during a turning motion of the marine vehicle.

It is a further object of the present invention to provide a safety system for a marine vehicle wherein there are provided means for detecting a turning motion and means to ensure that the throttle operates for a predetermined period of time.

According to one aspect of the present invention, in a marine vehicle having a motor and throttle means for controlling the motor speed, there is provided the improvement wherein the marine vehicle has a safety system, the safety system comprising turning sensor means for detecting a turning motion of the marine vehicle, and means to maintain power to the motor for a predetermined period of time when the throttle means are abruptly released.

In a further aspect of the present invention, there is a provided a safety system for personal watercraft comprising sensor means for detecting a turning motion, and timer means connected to a throttle of the personal watercraft to operate the throttle at a predetermined level for a predetermined period of time when the sensor means detect a turning motion.

As aforementioned, when there is no power supplied to marine vehicles, they typically can not be steered. This is particularly the case with personal watercraft which use a turbine and a nozzle which provides the steering action for the watercraft. Often, in the case of an emergency, a novice operator will immediately release the throttle and thus lose the ability to steer around or avoid an obstacle.

The safety system of the present invention may be utilized in different types of marine vehicles although the increasing popularity of personal watercraft renders the invention particularly suitable for the same.

The engine, normally of an internal combustion type, is mounted within an engine compartment and generally has an exhaust manifold which receives exhaust gases from the engine and from the cooling jacket. The exhaust manifold communicates with the water trap and silencing device that is positioned forwardly within the engine compartment through an exhaust pipe. The water trap and silencing portion have a discharge exhaust tailpipe which extends rearwardly and terminates within a tunnel formed rearwardly of the engine compartment and is normally defined by a vertically extending bulkhead.

A jet propulsion unit is positioned within the tunnel rearwardly of the bulkhead with an output shaft extending through the bulkhead and being coupled to an impeller shaft of a jet propulsion unit for drawing water from a downwardly facing water inlet portion and discharging it through a steering nozzle.

As set forth above, the safety system includes sensor means for detecting a turning motion of the personal watercraft and timer means which are activated and function to maintain power to the motor for a predetermined period of time when the throttle means are abruptly released. The amount of time that the throttle means remain activated can vary depending upon the speed of the watercraft. Thus, at a higher speed, the need to maintain power to the motor exists for a shorter period of time compared to lower speeds. Accordingly, there can be a plurality of timers which are operative depending upon the speed of the vehicle.

In a preferred embodiment, there are means to detect whether the operator of the watercraft has one or both hands on the handlebar. Naturally, it would be undesirable to maintain a high engine output when the vehicle is not under control of the operator. Accordingly, means for sensing the presence of the hands of the operator on the handlebar may be employed and if both hands are not sensed, the output to the motor may be limited. For example, one could limit the motor speed to under 1500 rpm when only a single hand or no hands exert pressure on the handlebar.

The invention may include means for displaying a message and also the operational status of the safety system on a display panel. Thus, when certain conditions arise, an appropriate message may be displayed on the panel and as well, LEDs showing the status of the various components may be present.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
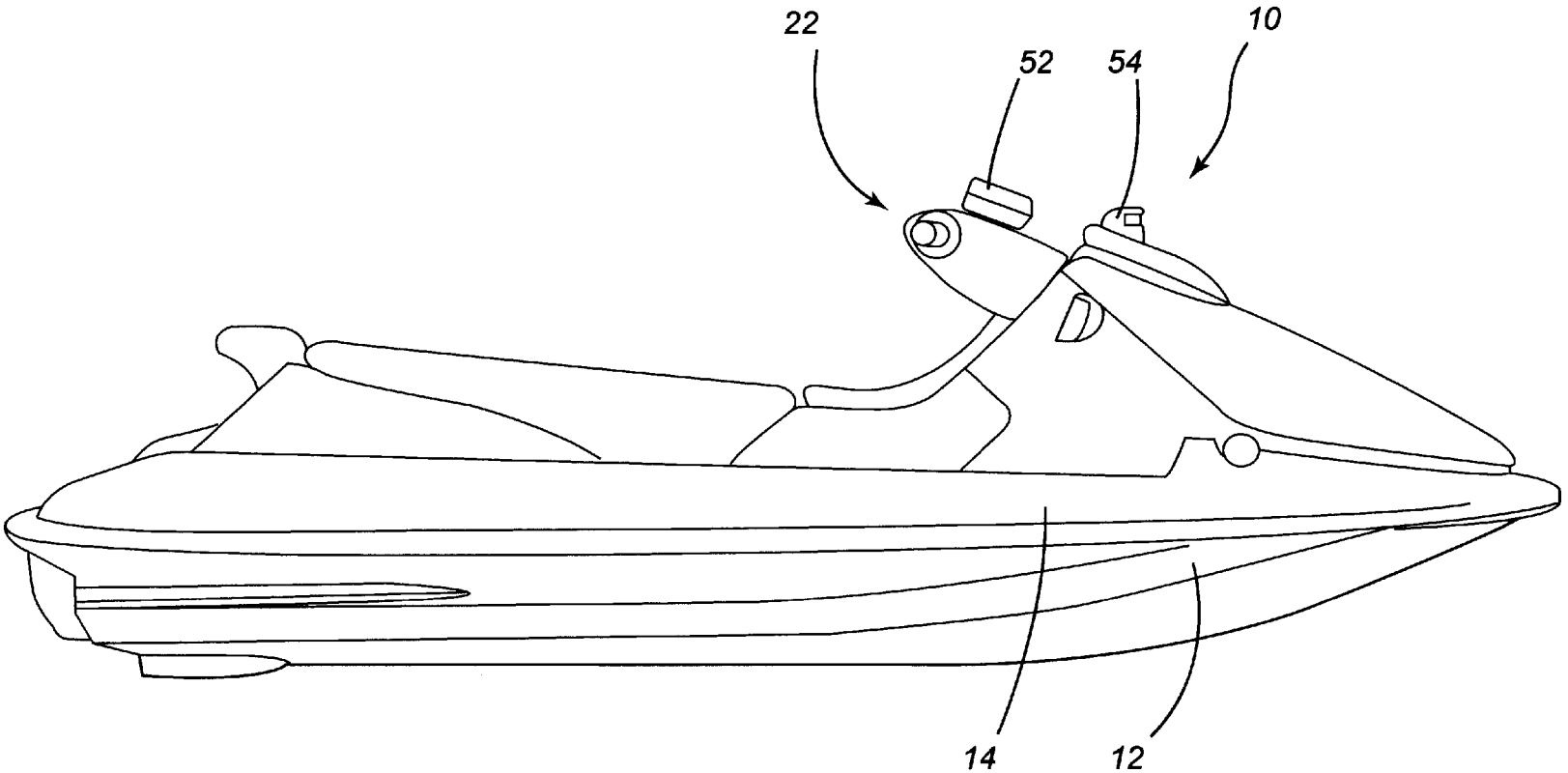
FIG. 1 is a side elevational view of a personal watercraft incorporating a safety system according to the present invention.
Figure 2:
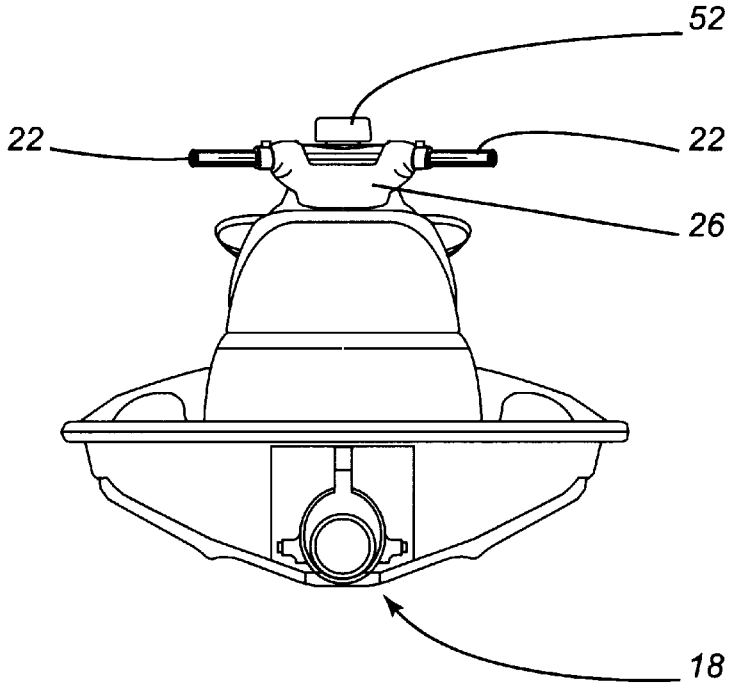
FIG. 2 is a front view thereof.
Figure 3:
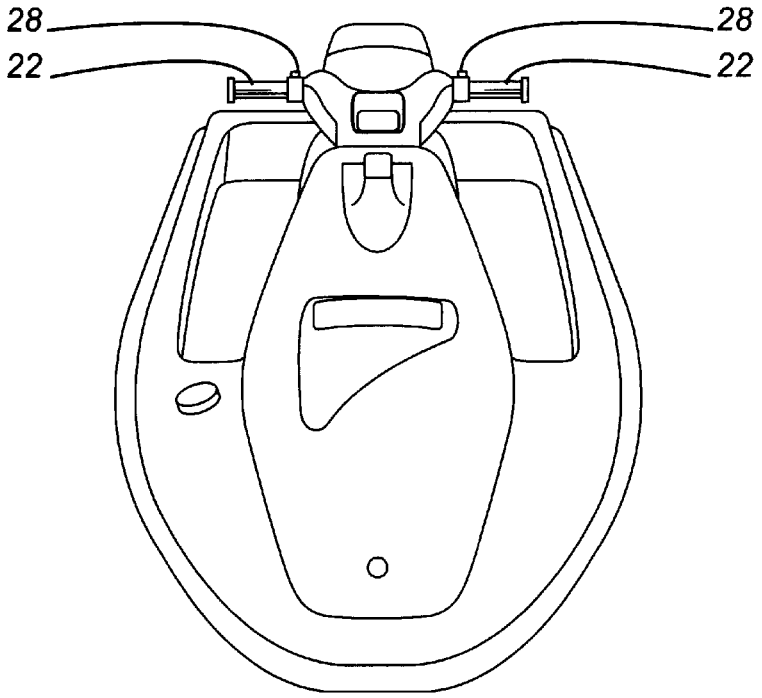
FIG. 3 is a rear view thereof.

Referring to the drawings in greater detail and by reference characters thereto, in FIG. 1 there is shown a conventional personal watercraft 10 of the jet propulsion type incorporating several improvements according to the present invention. The watercraft 10 includes a hull assembly made up of a lower hull portion 12 and an upper deck portion 14. The lower hull portion and the upper deck portion are typically formed of a suitable material such as a molded fiberglass reinforced polymeric resin or the like. The hull and deck portion 12, 14 have interlocking flanges which extend outwardly and define a gunnel extending around the outer periphery of the watercraft.

As is well known in the art, an engine compartment is formed centrally or at the front portion of the lower hull portion 12. An internal combustion engine of a known type is mounted within the engine compartment 16. An output shaft from the engine is coupled in a conventional manner to an impeller of the jet propulsion unit which normally draws water from a downwardly facing water inlet and discharges the water through a steering nozzle 18.

The personal watercraft further includes a seat 20 and handlebar assembly 22. The handlebar assembly 22 is operatively connected to the steering mechanism for steering the discharge nozzle 18 in a known manner. This may include a flexible transmitter having a connection to a lever arm fixed to the lower end of the handlebar. Other controls such as throttle control, engine kill switch and the like are also positioned forwardly of the seat in proximity to or on the handlebar assembly. The seat 20 is supported on a raised pedestal 24 which is surrounded by depressed foot areas 26. The watercraft insofar described is of a conventional nature and it should be understood that other marine vehicles could be used with the present invention without departing from the scope of the invention.

In accordance with one embodiment of the present invention, there is provided a safety system for non emergency situations including a pair of sensors 26 adapted to be activated when the handlebar 22 is rotated in either direction through an angle greater than a predetermined angle.

Preferably, the system may also include pressure sensors 28 which are activated by a pressure exerted by either one or both hands of an intended rider on the handlebar.

The system further includes a pair of adjustable pressure switches 30 and 32 or similar devices adapted to be respectively activated when the vehicle travels at or above a predetermined speed. For example, switch 30 may be activated at 8 kph with switch 32 being activated at 30 kph. The system further includes a throttle switch 34 which is activated when the throttle is in a neutral position.

Adjustable switches 30 and 32, as aforementioned, are activated at different predetermined speeds. When activated, the throttle in turn is activated to build up pressure in the turbine for a predetermined period of time depending upon which switch is activated. For example, if the lower speed switch 30 is activated, the throttle acceleration will continue for a first set period of time[\M]for example, in the area of 2 to 3 seconds.

On the other hand, when the switch 32 is activated, the throttle will be activated for a period of, for example, between 1 and 2 seconds. In both instances, the time would be sufficient for the turning motion to continue.

A timer is preferably provided for creating a delay before reactivation of the module once the module has been initially turned on. Thus, the module is only reactivated when all the switches are turned on in a desired order.

The build up in pressure in the turbine may occur when the handlebar is turned at a predetermined angle which may vary between 25 and 60 degrees.

Figure 6:
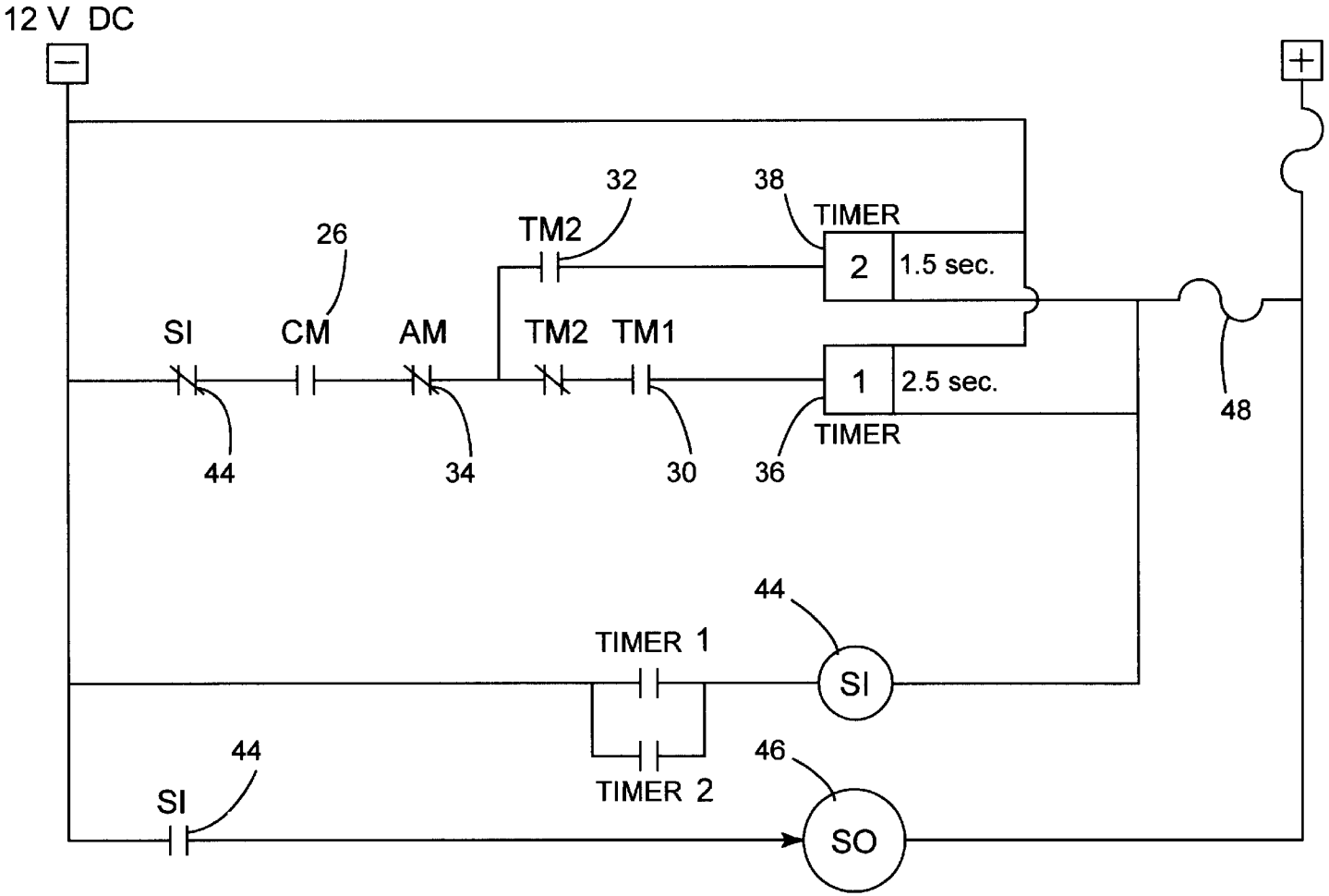
FIG. 6 is a schematic view of a portion of the electrical circuitry for one embodiment of the safety system.

As shown in FIG. 6, first timer 36 may be associated with switch 30 while a second timer 38 is utilized with switch 32. Thus, the different time values may be adjusted depending on the weight of the watercraft, motor size and other factors and operational parameters.

In a preferred embodiment, sensors 28 sense the pressure on the handlebar by either one or both hands of the operator. Sensors 28 may then operate to limit the motor speed to a lower level when either a single hand or no hands exert pressure on the handlebar so as to not cause a sudden acceleration when the rider is not prepared.

As shown in the schematic of FIG. 6, the circuit includes solenoids 44, relay 46 and a fuse 48. The circuit may be powered from the 12 volt DC battery of the vehicle.

The modular components are enclosed within a suitable housing which would typically be waterproof, explosion proof and the like.

A second embodiment of the invention includes the provision of a display screen 52 mounted for easy visual access by the operator of the personal watercraft. The display screen 52 may be utilized for displaying a message reminding the rider that he or she must accelerate the watercraft in order to steer the same. This message may serve as a reminder for beginners and the like. This embodiment also includes a motion sensor 54 mounted on the watercraft adjacent handlebars 22.

In this embodiment, pressure sensors 28 are provided for detecting a grasping pressure exerted by the rider on one of both of the handlebars 22. This embodiment also uses a turning sensor 26 which is activated whenever handlebar 22 is turned greater than a predetermined angle in either direction. Throttle switch 34 is also provided for activation when the throttle is in the neutral position. However, contrary to the first embodiment, activation of throttle switch 34 immediately sends a signal to display screen 53 to remind the operator about the need to accelerate prior to steering the watercraft.

In this embodiment, there are provided three angle detection switches 58 which are preferably of the mercury type. Two are positioned at 0 degrees while the third one is positioned at approximately 10 degrees. Whenever the watercraft is in motion with the rider in a generally stable position, if the accelerator is released, the watercraft pitches such that its front end pivots about 12 degrees relative to the rearward end. With the rider in a stable condition and the watercraft accelerating without any steering action, the watercraft will be laterally stable and sensors positioned on either side should remain at 0 degrees indicating the absence of any pitching action. However, when the forward tilting reaches a value above 10 degrees, motion sensor 54 is activated.

Motion sensor 54 senses the presence of moving objects within a predetermined range. Thus, the motion detector is designed to be activated wherein the watercraft is heading towards an obstacle.

This embodiment also includes a speed sensor 56 which may be preset to a predetermined speed to be activated. Thus, for example, if the speed sensor senses a speed above, for example, 20 kph, the module is activated and the throttle is turned on for a predetermined period of time. This would typically be in the range of 1 to 3 seconds while the turbine pressure is increased and the handles are turned approximately 45 degrees so as to veer the watercraft away from the obstacle. At the same time, a message is displayed on the display screen 52 to remind the user to accelerate in order to steer the watercraft. There may be provided a delay time having an adjustable time variable to open the circuit for a period of time prior to reactivating the module.

Figure 4:
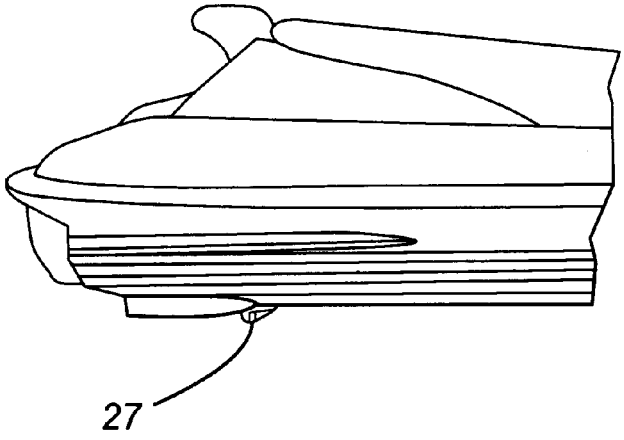
FIG. 4 is a partial view of the rear section of the personal watercraft indicating placement of a sensor used in the safety system.
Figure 5:
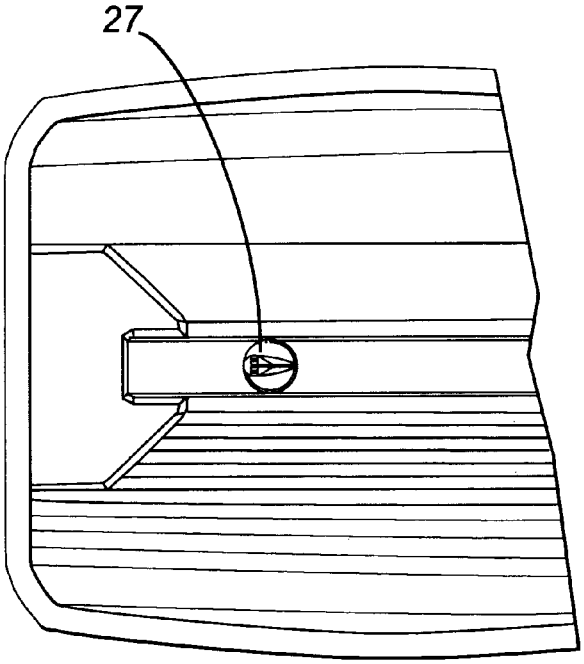
FIG. 5 is a bottom view thereof.
Figure 8:
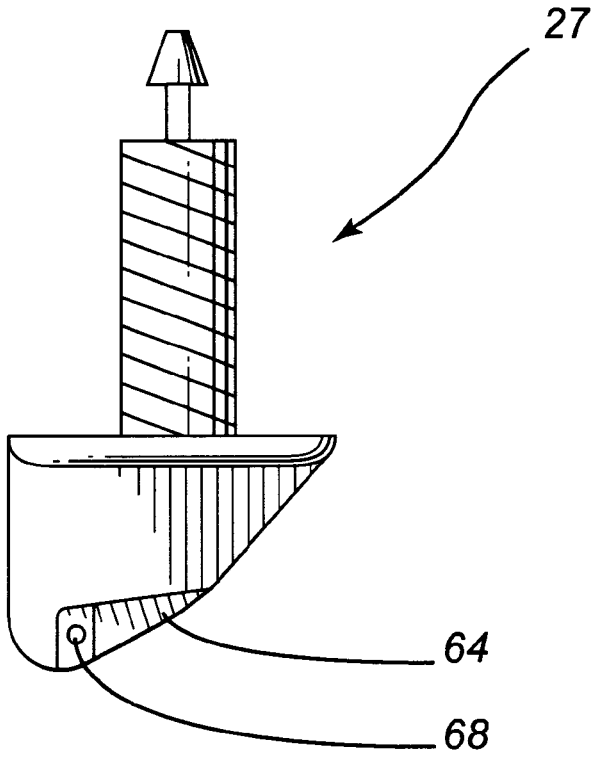
FIG. 8 is a side elevational view of an improved sensor used with the safety system of the present invention.
Figure 9:
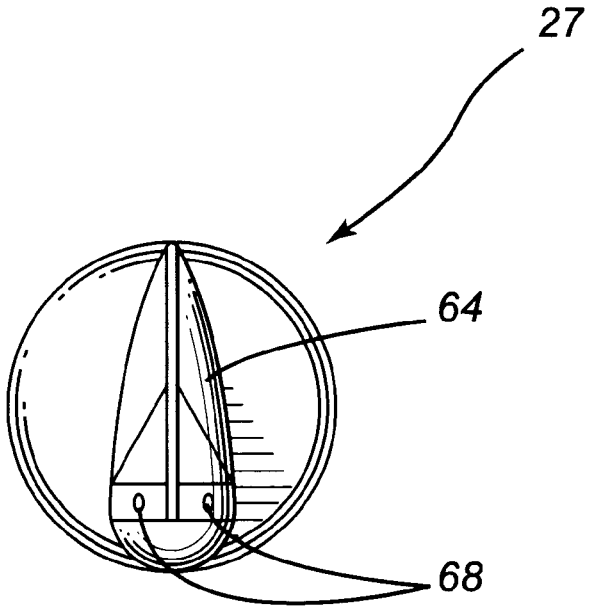
FIG. 9 is a bottom view thereof.

Turning to FIGS. 8 and 9, there is illustrated an improved pressure sensor which is generally designated by reference numeral 27. Pressure sensor 27 is generally of the known type and, as shown in FIGS. 4 and 5, is designed to fit under the watercraft. In the embodiment of FIGS. 8 and 9, there is provided a triangular lateral plate 64 having two apertures 68 as may be best seen in FIG. 9. Each of apertures 68 leads to an internal conduit and which conduits are connected together prior to feeding to the sensor. Thus, should one of the apertures 68 become blocked, the remaining aperture will still supply water to the sensor and the pressure therein will tend to dislodge any extraneous material which would cover the other aperture.

Figure 7:
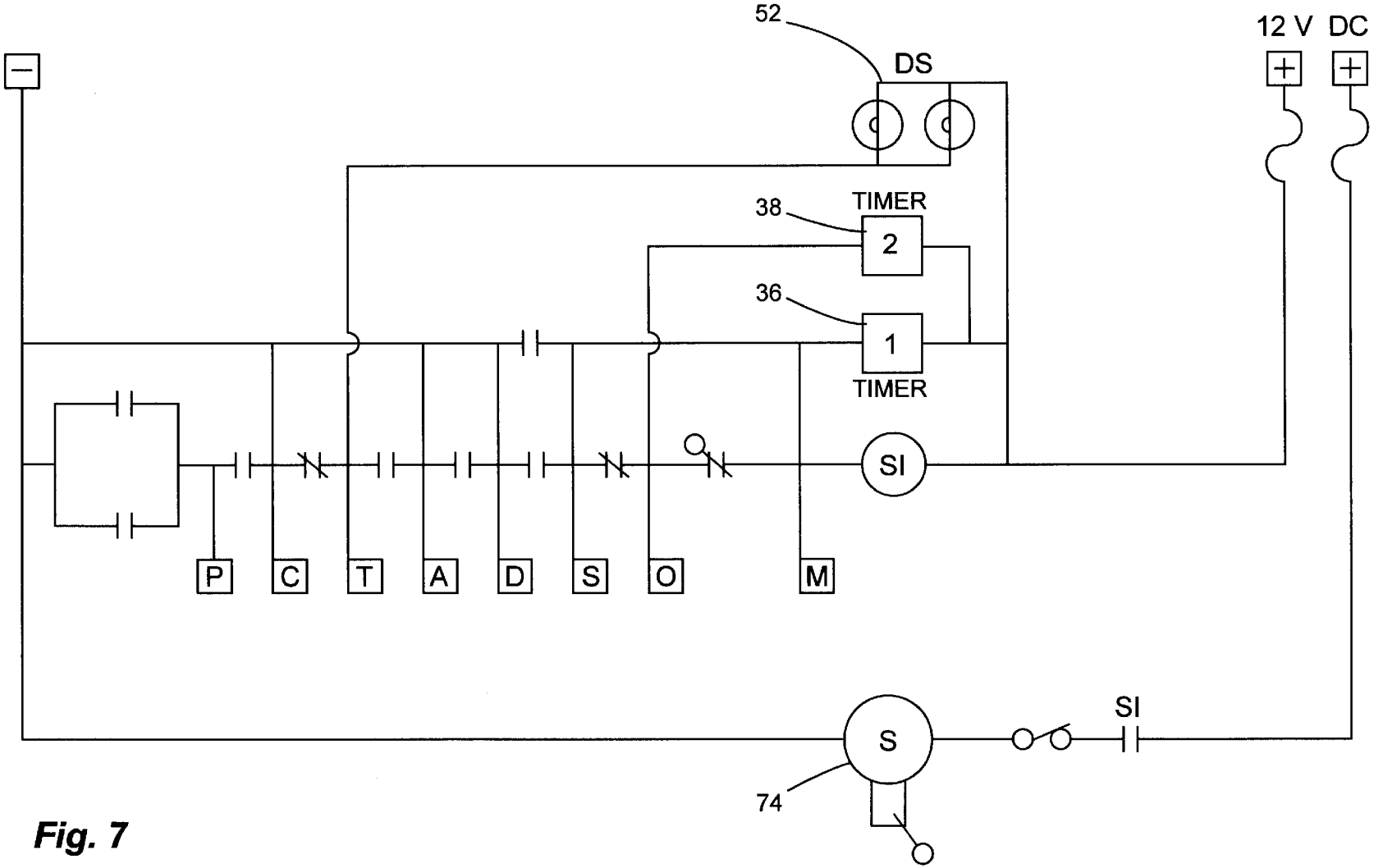
FIG. 7 is a schematic electric diagram illustrating the circuit for emergency avoidance.

The schematic of the circuit for the second embodiment utilizing a motion detector is illustrated in FIG. 7. As shown, the circuit has a number of inputs and operates on a 12 volt DC power from the watercraft. In the schematic, P represents the handlebar sensor, C represents an input from the throttle, T is the pressure buildup in the turbine, A is the input from angle detection switches 58, S is the input from speed sensor 56, O represents the timers 36 and 38, and M is a solenoid valve. There is also provided a main on/off switch 74.

The safety system is preferably operative only above a certain speed—generally such a speed would be in the range of 15 to 20 kph.

It will be understood that the above described embodiments are for purposes of illustration only and that changes and modifications may be made thereto without departing from the spirit and scope of the invention.

I claim:

1. In a marine vehicle having a motor and throttle means for controlling the motor speed, the improvement wherein said marine vehicle has a safety system, said safety system comprising first sensor means for detecting a turning motion of said marine vehicle, and means to maintain power to said motor for a predetermined period of time when said throttle means are abruptly released during a turning motion.

2. The improvement of claim 1 wherein said marine vehicle is a personal watercraft.

3. The improvement of claim 2 wherein said first sensor means for detecting a turning motion of said personal watercraft comprises at least one sensor mounted on a handlebar of said personal watercraft.

4. The improvement of claim 2 further including second sensor means mounted on a handlebar of said personal watercraft, said second sensor means being operative to sense the presence of an operator's hand, and throttle limiting means operatively connected to said second sensor means for limiting the power supplied to said motor when said second sensor means do not sense the presence of an operator's hand.

5. The improvement of claim 2 further including a display panel mounted on said personal watercraft, said display panel being operatively connected to said first sensor means to display an appropriate message.

6. The improvement of claim 5 further including means on said display panel to indicate operational status of said safety system.

7. The improvement of claim 2 further including speed sensing means, and said means to maintain power to said motor for a predetermined period of time being responsive to said speed setting means to vary the predetermined period of time according to a speed of the personal watercraft.

8. The improvement of claim 2 further including motion detector means mounted on said personal watercraft, said motion detector means being operative to sense the presence of an object within a predetermined distance from said personal watercraft.

9. A safety system for personal watercraft comprising sensor means for detecting a turning motion, and timer means connected to a throttle of said personal watercraft to operate said throttle at a predetermined level for a predetermined period of time when said sensor means detect a turning motion.

* * * * *